US007182110B2

(12) United States Patent
Roebuck

(10) Patent No.: US 7,182,110 B2
(45) Date of Patent: Feb. 27, 2007

(54) FLUID DISPENSING SYSTEM WITH TIMED SEQUENCE FILL CYCLE

(76) Inventor: John T. Roebuck, 19265 Monte Vista Dr., Saratoga, CA (US) 95070

( * ) Notice: Subject to any disclaimer, the term of this patent is extended or adjusted under 35 U.S.C. 154(b) by 130 days.

(21) Appl. No.: 11/113,164

(22) Filed: Apr. 25, 2005

(65) Prior Publication Data

US 2006/0237094 A1 Oct. 26, 2006

(51) Int. Cl.
*B65B 1/04* (2006.01)

(52) U.S. Cl. ..... 141/302; 141/244; 141/247

(58) Field of Classification Search ..... 141/301, 141/302, 2, 18, 13, 234–238, 242–247; 222/638, 222/639–644

See application file for complete search history.

(56) References Cited

U.S. PATENT DOCUMENTS 5,105,859 A * 4/1992 Bennett et al. ..... 141/102
5,168,905 A * 12/1992 Phallen ..... 141/1
5,823,234 A * 10/1998 Boertz ..... 141/67
5,871,121 A * 2/1999 Hashimoto et al. ..... 222/54
5,957,171 A * 9/1999 Matsuo ..... 141/83
6,176,277 B1 * 1/2001 Mayer ..... 141/82
6,689,621 B2 * 2/2004 Merten et al. ..... 436/180

* cited by examiner

*Primary Examiner*—Steven O. Douglas
(74) *Attorney, Agent, or Firm*—Paul Hentzel

(57) ABSTRACT

Fluid dispensing system 10 dispenses a controlled measure of fluid stock from a stock source 10S into stock receptacles 10C during a fill cycle. Flow manifold 12 receives the stock for distribution to the receptacles. The fluid stock may be pressurized by a gravity pressure head or by stock pump 10P operating between the stock source and the manifold. A fill spout 10F protrudes through system housing 10H for passing the stock into each stock receptacle. Electric solenoids 16, are positioned in the flow paths for providing the controlled measure of fluid stock. Flow adjusters adjust the fluid flow to the desired controlled measure. Fill trays 10L and 10R extend along the lower side edges of the housing, and support the stock receptacles during the fill cycle.

33 Claims, 6 Drawing Sheets

10

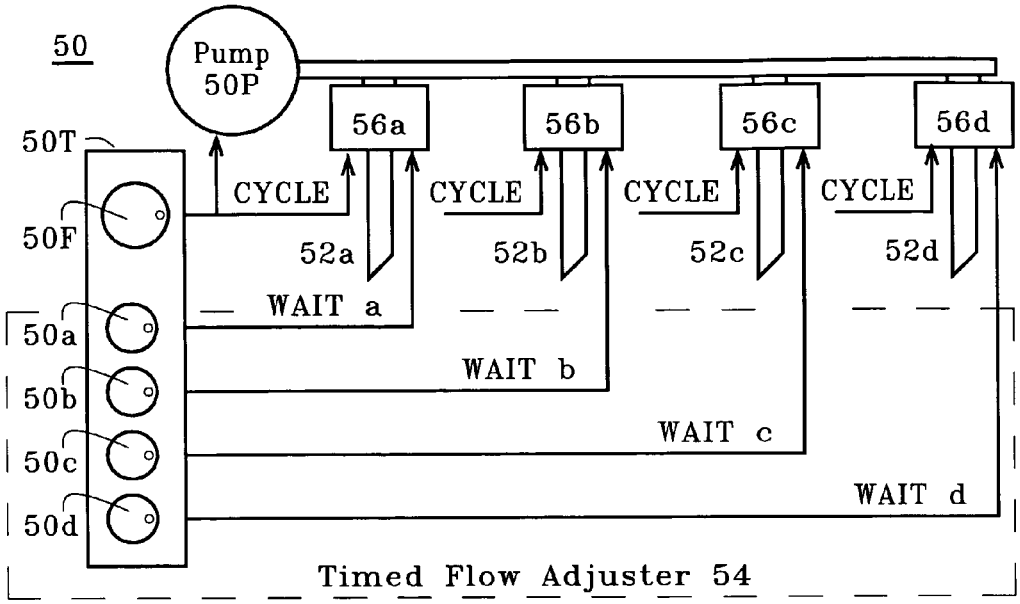
FIG. 5A
FIG. 5B
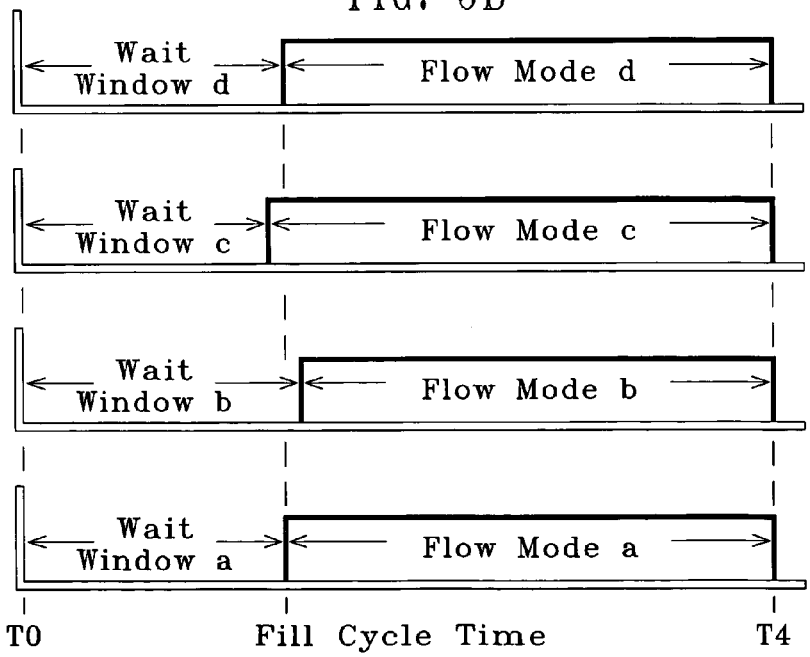

FLUID DISPENSING SYSTEM WITH TIMED SEQUENCE FILL CYCLE

TECHNICAL FIELD

This invention relates to automated systems for dispensing fluid commodities, and more particularly to such systems which execute a timed sequence of events defining a fill cycle.

BACKGROUND

Heretofore, hand-operated fluid dispensers, such as employed in small wineries, were attention intensive, inefficient, and highly subject to accidents and errors. Typically the bottles were filled one at a time using a hand operated fill nozzle at the end of a fill hose. The operator was required to monitor the rising level of the wine in each bottle, and shut-off the fill nozzle at the correct level. Underfills and overfills were common. Occasionally an overflow out the top of the bottle would splash onto the operator and over the work station.

SUMMARY

It is therefore an object of this invention to provide a fluid dispensing system employing an automated timed sequence of events which define a complete fill cycle. Once the sequence is initiated through a timer, each event of the sequence is self actuating until termination of the sequence at the end of the fill cycle. The system is automatic, and dispenses a controlled measure of fluid stock without close monitoring or intervention by operators.

It is another object of this invention to provide such a fluid dispensing system having a flow adjuster for adjusting the controlled measure of stock dispensed into each receptacle. The flow rate to each receptacle may be adjusted by mechanical constriction devices in the flow path to each receptacle. The flow time may be adjusted by a flow timers.

It is another object of this invention to provide such a fluid dispensing system which can execute mixed runs and partial runs of fluid stock. The system has a flexible distribution format, and can assign a different controlled measure to different sub-portions of the system during a mixed run. The system also has a flexible flow format, and can disable portions of the distribution during a partial run.

It is a further object of this invention to provide such a fluid dispensing system with an improved laminar flow, involving minimal turbulence and environmental exposure.

Briefly, these and other objects of the present invention are accomplished by providing an apparatus for dispensing a controlled measure of pressurized fluid stock from a stock source into stock receptacles, during a fill cycle. A flow manifold has an input port for receiving the pressurized fluid stock and output ports for distributing the pressurized stock. Stock flow paths begin at the manifold output ports and end at each stock receptacle. A fill spout at the receptacle end of each flow path, passes the controlled measure of fluid stock into each stock receptacle. Flow valves in the flow paths open to allow the flow of fluid stock through the flow paths into the stock receptacles. Flow adjusters associated with at least some of the flow paths adjust the fluid flow to the desired controlled measure. A system timer establishes a timed sequence of events defining a fill cycle of operation for the apparatus.

BRIEF DESCRIPTION OF THE DRAWINGS

Further objects and advantages of the present fluid dispensing system and the operation of the timed sequence will become apparent from the following detailed description and drawings (not drawn to scale) in which:

FIG. 5A is a flow schematic of fluid dispensing system 50 showing timed flow adjuster 54 with timed signals WAIT a–d applied to solenoids 56*a–d*; and FIG. 5B is a timing diagram showing timed Wait Windows a–d and Flow Modes a–d for the operation of system 50.

Figure 1:
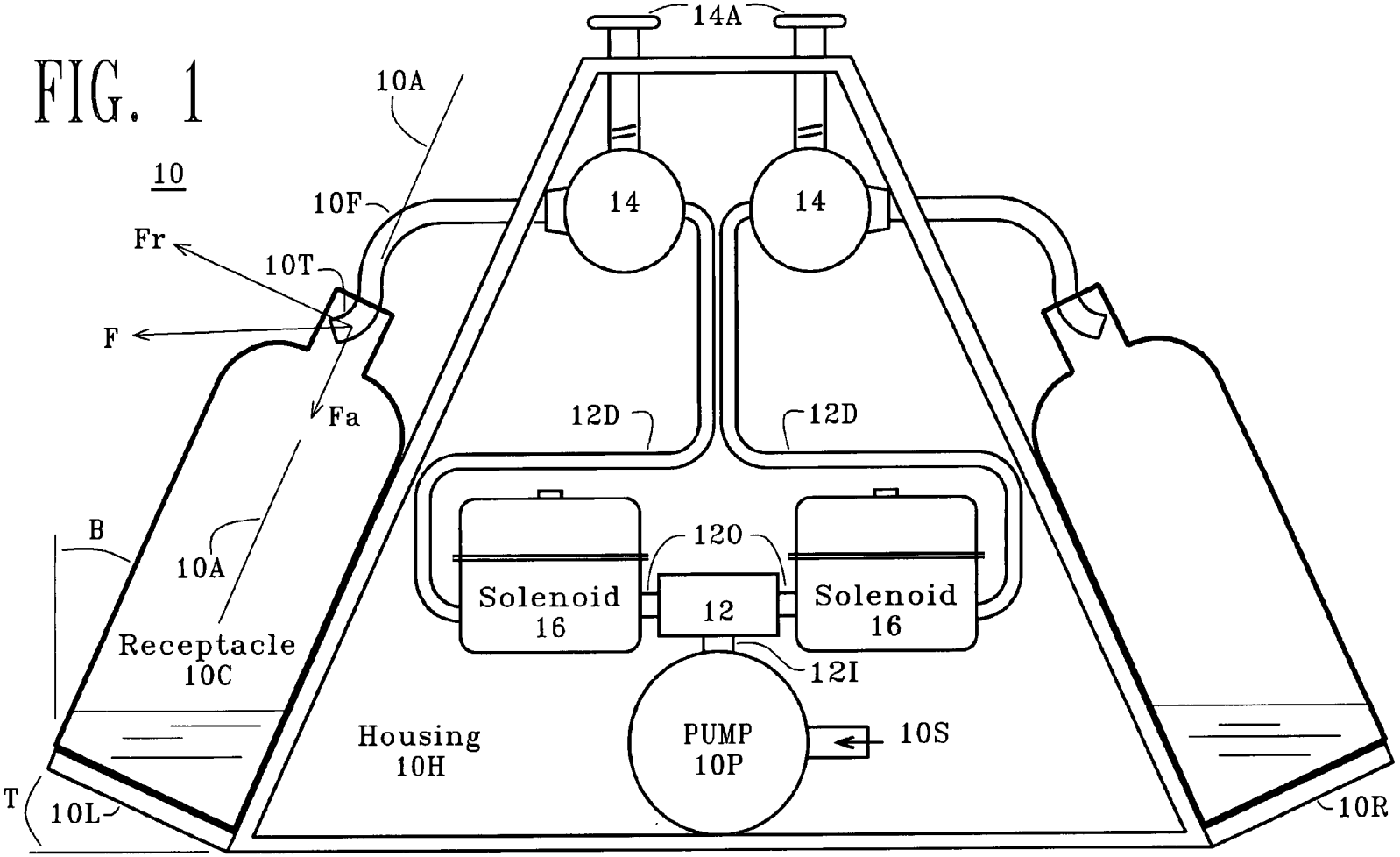
FIG. 1 is an open end view of fluid dispensing system 10 showing inclined receptacle 10C receiving fluid stock from stock source 10S.

The elements and features of the invention are designated by the two digit reference numerals in the above figures. The first digit indicates the figure in which that element or feature is first disclosed or is primarily described. The second digit indicates like elements or features throughout the figures. Some reference numerals are followed by a letter which indicates a sub-portion or related structure of that element or feature.

REFERENCE NUMERALS IN DRAWINGS

The table below lists the reference numerals employed in the figures, and identifies the element designated by each numeral.

| | | |
|---|---|---|
| 10 | Fluid Dispensing system 10 | |
| | 10A | Axis of Receptacle 10A |
| | 10C | Inclined Stock Receptacles 10C |
| | 10F | Receptacle Fill Spouts 10F |
| | 10H | System Housing 10H |
| | 10L | Fill Tray 10L |
| | 10P | Stock Pump 10P |
| | 10R | Fill Tray 10R |
| | 10S | Fluid Stock Source 10S |
| | 10T | Tip of Fill Spout 10T |
| 12 | Flow Manifold 12 | |
| | 12D | Distribution Flow Paths 12D |
| | 12I | Input Port 12I |
| | 12O | Output Ports 12O |
| 14 | Flow Constrictors 14 | |
| | 14A | Flow Adjustment Mechanism 14A |
| 16 | Flow Solenoids 16 | |
| 20 | Fluid Dispensing System 20 | |
| | 20B | Start Button 20B |
| | 20F | Fill Cycle Timer 20F |
| | 20G | Sparge Gas Timer 20G |
| | 20P | Flow Pump 20P |
| | 20S | Fluid Stock Source 20S |
| | 20T | System Timer 20T |
| | 20W | Wait Timer 20W |

-continued

| | |
|---|---|
| | 21A Sparge Injection Apertures 21A |
| | 21C Sparge Check Valves 21C |
| | 21L Sparge Line 21L |
| | 21S Sparge Gas Source 21S |
| | 21V Sparge Release Valve 21V |
| 22 | Flow Manifold 22 |
| | 22B Back Pressure Switch 22B |
| | 22D Stock Flow Paths 22D |
| | 22T Manifold Pressure Tail 22T |
| | 22S Manifold Standby Pressure 22S |
| 24 | Flow Constrictors 24 |
| 26 | Flow Solenoids 26 |
| | 26T Solenoid Flow Tail 26T |
| | 30C Continuous Measure Selectors 30C |
| | 30L Long Fill Spout 30L |
| | 30M Medium Fill Spout 30M |
| | 30P Preset Measure Selectors 30P |
| | 30S Short Fill Spout 30S |
| | 30V Voltage Detector Circuit 30V |
| | 36D Flow Disable Switches 36D |
| | 36T Top-off Over Ride Switch 36T |
| | 40C Stock Receptacles 40C |
| 44 | Flow Constrictors 44 |
| 46 | Flow Solenoids 46 |
| 50 | Fluid Dispensing system 50 |
| | 50a–d Wait Timer 50a–d |
| | 50F Fill Cycle Timer 50F |
| | 50P Stock Pump 50P |
| | 50T System Timer 50T |
| 54 | Timed Flow Adjuster 54 |
| | 56a–d Flow Solenoids 56a–d |

General Embodiment—(FIG. 1)

Fluid dispensing system 10 mounted within system housing 10H dispenses a controlled measure of pressurized fluid stock from a stock source 10S into stock receptacles or containers 10C during a fill cycle. Flow manifold 12 has input port 12I for receiving the pressurized stock and output ports 12O for distributing the fluid stock to the receptacles. Preferably, the flow manifold has limited volume in order to minimized end of run loss of the fluid left within the manifold after the last run of a work shift. Preferably, the volume of the manifold is greater than the collective volumes of the solenoid chambers, to promote stable flow through the manifold. The fluid stock may be pressurized by a gravity pressure head or by stock pump 10P operating between the stock source and the manifold input port. Gravity and/or pump pressure forces the fluid stock into the manifold and out through distribution flow paths 12D to receptacle fill spouts 10F. Any suitable pump which provides a smooth, non-pulsating flow may be employed. Multi-piston diaphragm pumps may offer a phased pumping progression which combine to produce a more even fluid flow.

The distribution flow paths begin at manifold output ports 12O and end at each stock receptacle 10C. The conduits forming distribution flow paths 12D may be any suitable material such as rubber hosing, plastic conduit, and metal tubing. The material of the conduits is preferably a food grade substance such as silicon, which is devoid of any detectable taste or scent. Industrial systems for non-food applications may employ non-food grade conduits. A fill spout protrudes through the housing at the receptacle end of each flow path, for passing the stock into each stock receptacle. These fill spouts may be mounted on the housing close to flow constrictor 14 in that flow path. That is, the constrictor is preferably mounted near the receptacle end of the flow path. The receptacles may be any suitable containers such as bottles, jars, cans, tubs, etc.

Start/stop flow valves, such as open/close electric solenoids 16, are positioned in the flow paths between the manifold output ports and the fill spouts, for providing the controlled measure of fluid stock. The controlled measure may be in various units, including volume, weight, and time duration of stock flow. Flow adjusters such as mechanical constrictors 14 shown in FIG. 1 and timed flow adjuster 54 shown in FIG. 5A, may be provided in at least some of the flow paths for adjusting the fluid flow to the desired controlled measure. Constrictors 14 are positioned in the flow paths between the solenoids and the fill spouts. Flow adjust mechanism 14A on at least some of the flow constrictors may be provided for adjusting the fluid flow through that flow constrictor. The mechanical constrictors may be any suitable constriction or metering device, such as internal needle valves, or external noninvasive clamp valves, which limit the distribution flow rate to less than the maximum pump rate. The flow constrictor in each distribution flow path is preferably positioned proximate the receptacle end of that flow path, in order to minimize possible flow rate variations and interruptions. Fill trays 10L and 10R extend along the lower side edges of the housing, and support a left row and a right row of inclined stock receptacles during the fill cycle. Only the end receptacle (and solenoid and constrictor and fill spout) in each row are shown.

Fluid Stock

The fluid stock may be any substance having a viscosity suitable for system dispensing through conduits. The fluid stock may be a liquid such as wine, milk, water, oil or other bulk commodity. The fluid stock may be a gaseous vapor. The fluid stock may be an ointment, lotion, pastes, health and beauty aides, shampoos, soaps, sauces, grease, or other viscous substance. The fluid stock may be a host carrier for medication or other additives, which are dissolved, suspended, or dispersed in the carrier.

Figure 2A:
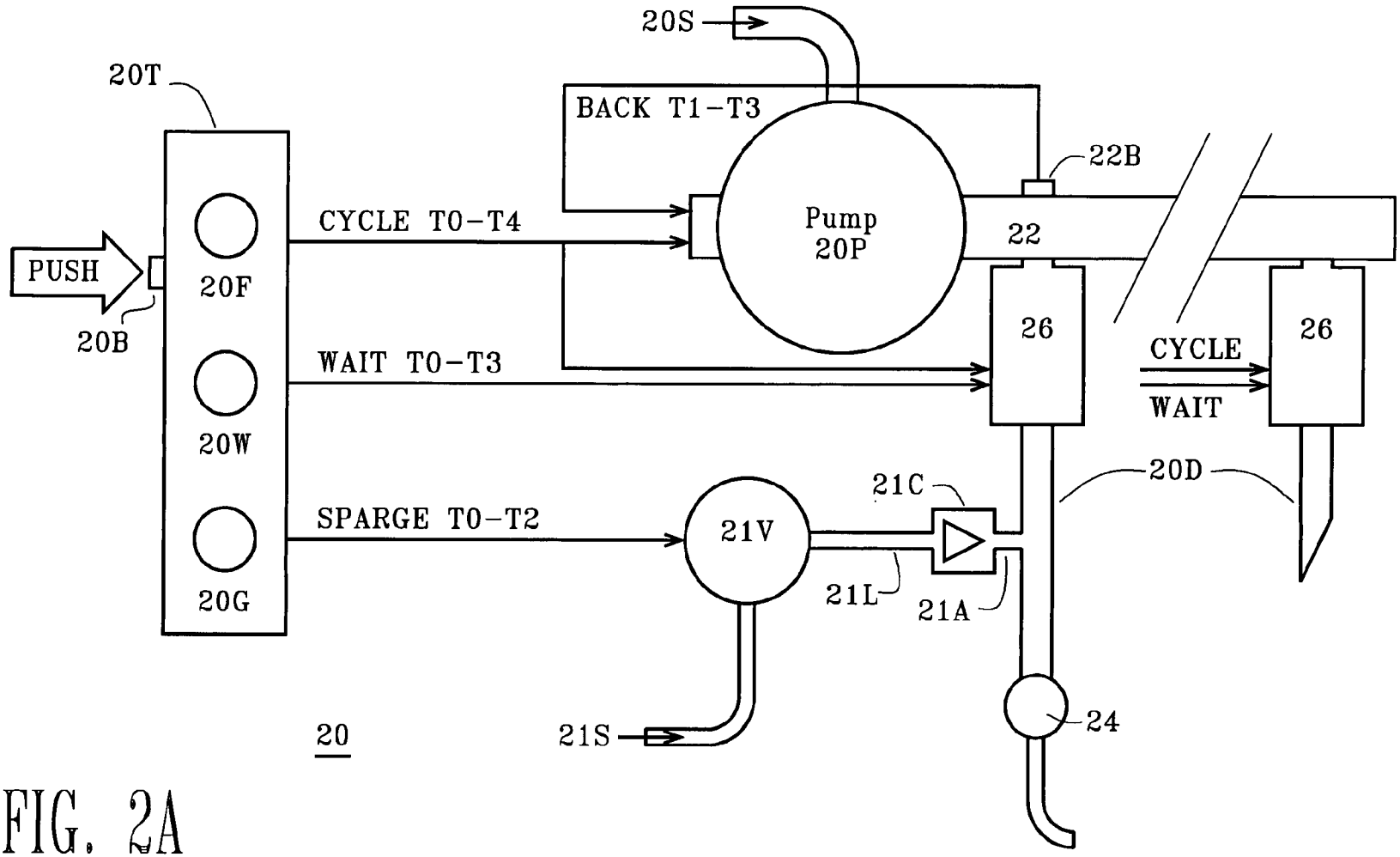
FIG. 2A is a flow schematic of fluid dispensing system 20 showing system components, and timed signals applied to the system by system timer 20T.
Figure 2B:
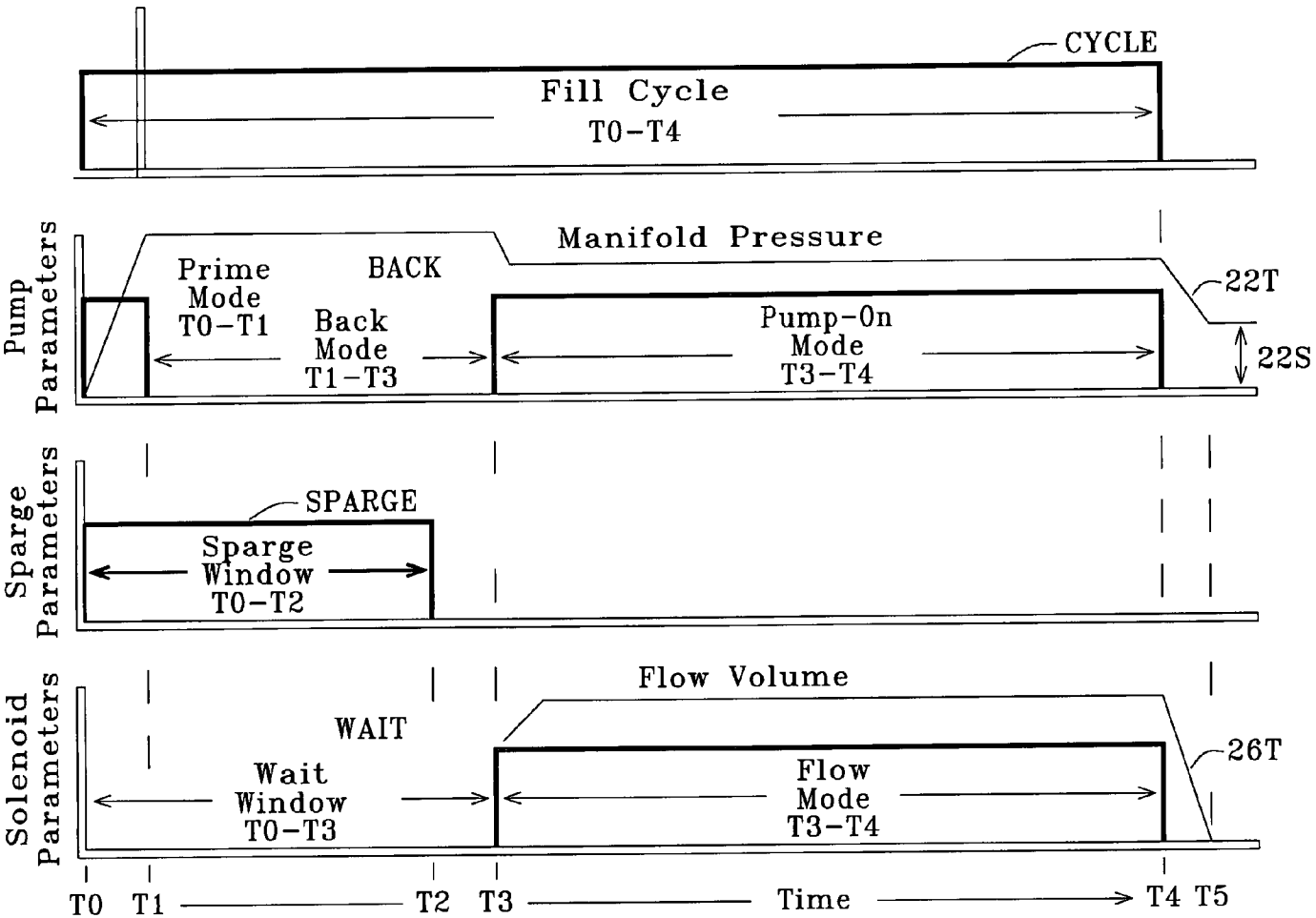
FIG. 2B is a timing diagram showing the timed sequence and waveforms of the applied signals of FIG. 2A.

General Operation—(FIGS. 2A and 2B)

System timer 20T establishes a timed sequence of events defining a complete fill cycle of operation for fluid dispensing system 20. The flow schematic of FIG. 2A shows the components and flow connections and signals applied to the components within dispensing system 20. Timed signal CYCLE is applied from timer 20T to pump 20P between T0 to T4 for defining the duration of the fill cycle and for operating the pump. The pump turns on at T0 and turns off at T4. Timed signal WAIT is applied from timer 20T to flow solenoids 26 between T0 and T3 for delaying the opening of the solenoids for a short time at the beginning of each fill cycle. At T3, the solenoids open and fluid stock starts filling the receptacles. Timed signal SPARGE is applied from timer 20T to sparge release valve 21V between T0 and T2 for releasing a sparge agent into the major stock flow before T3. The spare agent may be a minor flow of an additive to the major stock flow, or an inert gas. Internal signal BACK is presented to the pump between T1 and T3 by back pressure switch 22B mounted on flow manifold 22. BACK stalls the operation of the pump until T3.

The timing diagram of FIG. 2B (not drawn to scale) shows the sequence of three timed windows (in bold), Wait Window and Sparge Window and Fill Cycle (window) defining a complete fill sequence between T0 and T4. The figure also shows four operational modes, Prime Mode, Back Mode, Flow Mode and Pump-On Mode. System timer 20T starts the fill cycle at T0 when the receptacles are in place on the fill trays and an operator depresses start button 20B. This manual start event is indicated by PUSH in FIG. 2A. Alternatively, the start of the fill cycle may be automatic, and based on an external event. The fill cycle is terminated at T4 after the expiration of the timed windows.

Prime Mode (T0–T1)

The system defines Prime Mode between T0 and T1 during which the stock pump is on and stabilizes the volume and pressure of the fluid stock within the manifold. The duration of time between PUSH (T0) and manifold stabilization (T1) is typically a fraction of a second. The timer continues to apply CYCLE to the pump throughout the entire fill cycle between T0 and T4. However, the pump is stalled during the back mode.

Back Mode (T1–T3)

The pump initially turns on at T0. At T1 the back pressure building up in the flow monitor activates back pressure switch 22B. The switch responds to the stabilized internal pressure within the manifold, and applies BACK to stall the pump. During Back Mode between T1 and T3, the back pressure in the manifold maintains dispensing system 20 in a stalled state until T3 when the solenoids open. Typically, the back mode lasts from a fraction of a second to a second or so.

Sparge Window (T0–T2)

The timer defines Sparge Window between T0 and T2, during which the sparge system in the embodiment of FIGS. 2A and 2B releases inert sparge gas for shielding the fluid stock from ambient effects during the remainder of the fill cycle. The fluid dispenser is preferably a closed system with minimal exposure to environmental atmosphere, especially when dispensing degradable fluid stock such as wine. The usual degrading agent is ambient oxygen, however, the degrading could involve ambient tastes or odors. The inert sparge gas may be any chemically inert or non-reactive vapor, such as nitrogen gas or argon gas. Sparge Window (T0–T2) precedes Flow Mode (T3–T4). The sparge gas flushes the ambient oxygen out of the inclined receptacle before the fluid stock begins to pass into the receptacle. The gas provides a shield over the fluid stock during the flow mode as the receptacles fill. Preferably the sparge gas is heavier than air and will "hang" at the bottom of the receptacle to form a rising blanket shield over the rising fluid stock entering the receptacle.

Sparge line 21L delivers the inert sparge gas from sparge gas source 21S into the stock flow paths 22D. Sparge release valve 21V is positioned between the sparge gas source and the sparge line, and is responsive to SPARGE from gas timer 20G in timer 20T for releasing the sparge gas into the sparge line. Sparge injection apertures 21A in the stock flow paths between flow solenoids 26 and flow constrictors 24, inject the sparge gas into the stock flow paths. During the sparge window, the sparge release valve is open and the inert sparge gas is injected into the stock flow paths. Typically, a sparge window lasts for about 100 ms at a supply pressure of about from about 10 psi to about 12 psi. The short isolation period between T2 when the sparge window ends and T3 when the flow mode begins, prevents fluid stock from leaking into the sparge system. The sparge system may be employed for introducing a minor fluid stock to be dispensed in predetermined proportions with a major fluid stock. For example, the major flow may be deionized water and the minor flow may be a concentrate such as scented herbal substance or a soap additive.

Wait Window T0–T3

The timer defines Wait Window between T0 and T3 during which flow solenoids 26 are closed. The time duration of the wait window is defined by wait timer 20W.

Fill Cycle (Window) T0–T4

Fill cycle timer 20F defines Fill Cycle between T0 and T4 during.

Flow Mode T3–T4

The timer defines Flow Mode between T3 and T4 during which flow solenoids 26 are open and a controlled measure of fluid stock passes into the receptacles. As the solenoids open at T3, the back pressure in manifold 22 drops and back pressure switch 22B removes BACK from pump 20P. The pump is now free to operate in response to CYCLE from timer 20T. The time duration of the flow mode is the fill cycle time minus the wait time. For water based stock such as wine, a 750 ml bottle may be filled to the desired controlled measure in about 20 seconds. At T4 the flow solenoids close, the pump turns off, and the fluid stock stops flowing. The fill cycle is terminated. The next fill cycle may begin after an intermediate standby cycle during which the filled receptacles are transported to the next station, and new empty receptacles are placed on the fill trays.

Sparge Check Valves

Sparge check valves 21C may be installed in the sparge line between sparge release valve 21V and each sparge injection aperture 21A. The check valves are preferably spring-loaded in the closed position, and only permit gas flow in one direction, through the injection apertures and into the stock flow paths. These valves prevent reverse leakage of fluid stock from the flow paths into the sparge line. The check valves open during the sparge window in response to the pressure of the sparge gas in the sparge lines, and inject sparge gas into the flow paths. The check valves close when the sparge gas pressure is removed at the end of the sparge window.

Manifold Pressure

The operating pressures within the manifold are normally positive to prevent inward leakage of ambient oxygen. The manifold pressure is shown by light lines in the Pump Parameters section of FIG. 2B. The manifold pressure rises sharply during Prime Mode (T0–T1) to a priming pressure (about 45 psi) which is maintained during the short back mode. The flow solenoids are preferably mounted near the manifold end of the flow paths. These solenoids may be mounted directly on the manifold in order to reduce the surface area exposed to the high priming pressure. During the longer flow mode (and pump-on mode), the solenoids open and the manifold pressure drops to a flow pressure (about 10 or 20 psi). At the termination of the fill cycle (T4), power to the pump and to the flow solenoids is switched off. The manifold pressure drops toward zero.

However, the pump has a brief turn-off transient due to motion effects such as rotation inertia. The turn-off transient causes a small manifold pressure "tail" 22T. The solenoids start to close at T4 and the flow volume out of the manifold decreases rapidly. The flow volume is shown by light lines in the Solenoid Parameters section of FIG. 2B. The solenoids have a close transient which causes a small solenoid flow "tail" 26T out of the solenoids. The solenoid close transient is faster than the pump turn-off transient. Therefore, solenoid flow tail 26T is shorter and steeper than manifold pressure tail 22T. That is, the solenoids are completely closed and the flow out of the manifold is zero, before the manifold pressure can drop to zero. The early closing of the solenoids prevents the manifold pressure from completely escaping. A portion of the manifold pressure tail is trapped in the manifold as the solenoids close. The trapped pressure establishes a positive residual standby pressure 22S within the manifold during the standby cycle between fill cycles. The standby pressure prevents ambient air (primarily oxygen) from leaking into the manifold during the standby cycle. In addition, the standby pressure contributes to the high priming pressure required during the prime mode at the start of the next fill cycle.

Fill Trays—Fill Spouts

Fill trays 10L and 10R supporting receptacles 10C are inclined at a tray angle T, causing the receptacles (which in FIG. 1 are shown as wine bottles) to incline against system housing 10H at a leaning angle B. The housing has a side adjacent to the fill tray, which extends upwards at an angle away from the vertical for supporting the inclined receptacles. The tray incline may be from a low angle of about 20 degrees to a steep angle of about 30 degrees. The tray incline up from the horizontal, causes the corresponding bottle incline away from the vertical. Lower tray angles near the horizontal cause bottle leaning angles near the vertical, which may hinder removing and installing bottles during the standby cycle. Higher tray angles cause greater leaning angles, which increases the base width of the housing resulting in a bulky system. An angle of 25 degrees is suitable. Contours in the trays or the housing (or both) may be provided to "nest" and stabilize the bottles during the flow mode. As the bottles fill, they become heavier and more secure against the housing. Tip 10T of fill spout 10F extends into receptacle 10*c*, and may be bowed or bent slightly away from the housing toward the operator. This bend in conjunction with the tray incline facilitates the installation of empty bottles and removal of full bottles by the operator. In addition, the bend presents the tip of the spout along the inside surface of the bottle, and directs the wine flow into the bottle against the neck, promoting laminar fluid flow down the inside surface of the bottle. At the end of the fill cycle, the flow out of the tip terminates. Preferably, the contents of the fill spout do not dribble down into the bottle. The small diameter of the exit orifice in the tip together with the surface tension of the wine, prevents the escape of the spout contents. Preferably, the fill level of the wine in the neck of the bottle is below the spout tip. That is, the wine rising during the flow mode wine does not reach the tip. This precaution keeps the outside surface of the tip dry and free of small run-off drops.

Laminar Flow

The laminar flow of fluid stock from the fill spouts into the wine bottles minimizes turbulence and air entrainment as the flowing stock merges with the wine accumulating at the bottom of the bottle. Preferably, the entire system before the fill spout is closed, and has minimal environmental exposure. In a typical fluid dispensing system, only the final passing of the fluid stock into the receptacle involves exposure to ambient oxygen. The oxygen take-up during this short downward fall may be minimized by encouraging laminar flow against the inside surface of the receptacle.

As shown in FIG. 1, the flow of wine is guided down the inside surface of the bottle due to the bend in the spout tip. Flow F (shown schematically in FIG. 1) is directed by the spout tip and fans out into a curtain of laminar flow over the smooth glass surface of the bottle. Flow F has an axial component Fa parallel to axis 10A of the bottle, and a radial component Fr against the neck of the bottle. Radial component Fr is normal to axial component Fa. As the radial component strikes the neck, it forms a CW rotary component or a CCW rotary component (or both), depending on the position of the tip. The flow swirls downward hugging the inside surface of the bottle. The wine is held against the glass surface by the outward centrifugal force generated by the rotary component(s), and by the natural adhesion between the wine and the glass. In embodiments with sufficient rotary components, the curtain laminar flow extends completely around the inside of the receptacle forming a thin shroud of laminer flow. The smoothness of the inside surface promotes a smooth and uniform laminar shroud. The uniform laminar flow merges into the rising wine already in the bottle with minimal turbulence and entrainment of ambient air bubbles into the wine. Further, the laminar flow is shielded from ambient oxygen by contact with the glass on one side and by the sparge gas on the other side. Both the turbulence and shielding considerations become less significant as the wine level rises and downward laminar flow distance becomes shorter.

Equal Measure Embodiment

Fluid dispensing system 20 shown in FIG. 2A, dispenses an equal measure of fluid stock to each receptacle during the flow mode. In this equal measure embodiment, the receptacles may be a set of containers of the same size, which hold the same volume of fluid stock. The fluid flow rate through each flow constrictor is the same, and the flow solenoids are open for the same duration of time. The solenoids open at T3 and close at T4, and preferably have the same open and close transients.

Measure Selection

Fill cycle timer 20F defines the duration of the fill cycle and the controlled measure of fluid stock dispensed to the set of same size receptacles. Because the stock flow is constant, the quantity of the measure is dependent on the duration of the flow mode. The duration of the flow mode is the fill cycle (window) minus the wait window. The controlled measure may be increased (or decreased) by increasing (or decreasing) the duration of the flow mode, which may be accomplished by increasing (or decreasing) the fill cycle (window). That is, the controlled measure may be increased by advancing T4 to the right and decreased by retreating T4 to the left. The shifting of T4 to control the dispensed measure may define a continuous selection of measures (see continuous volume selector 30C in FIG. 3A). Alternatively, the shifting may define a series of preset standard measures (see preset volume selector 30P in FIG. 3A).

Figure 3B:
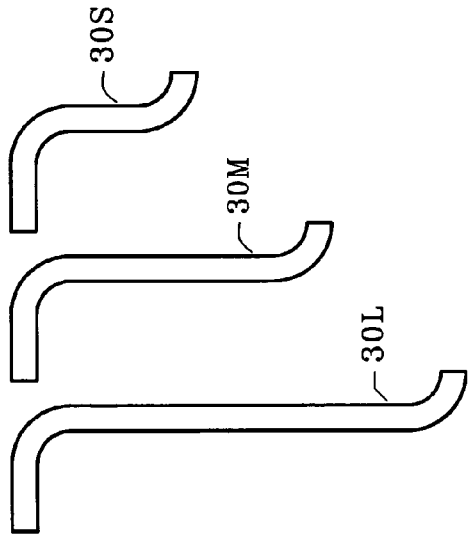
FIG. 3B shows fill spouts of different lengths for use with receptacles of different sizes.
Figure 3A:
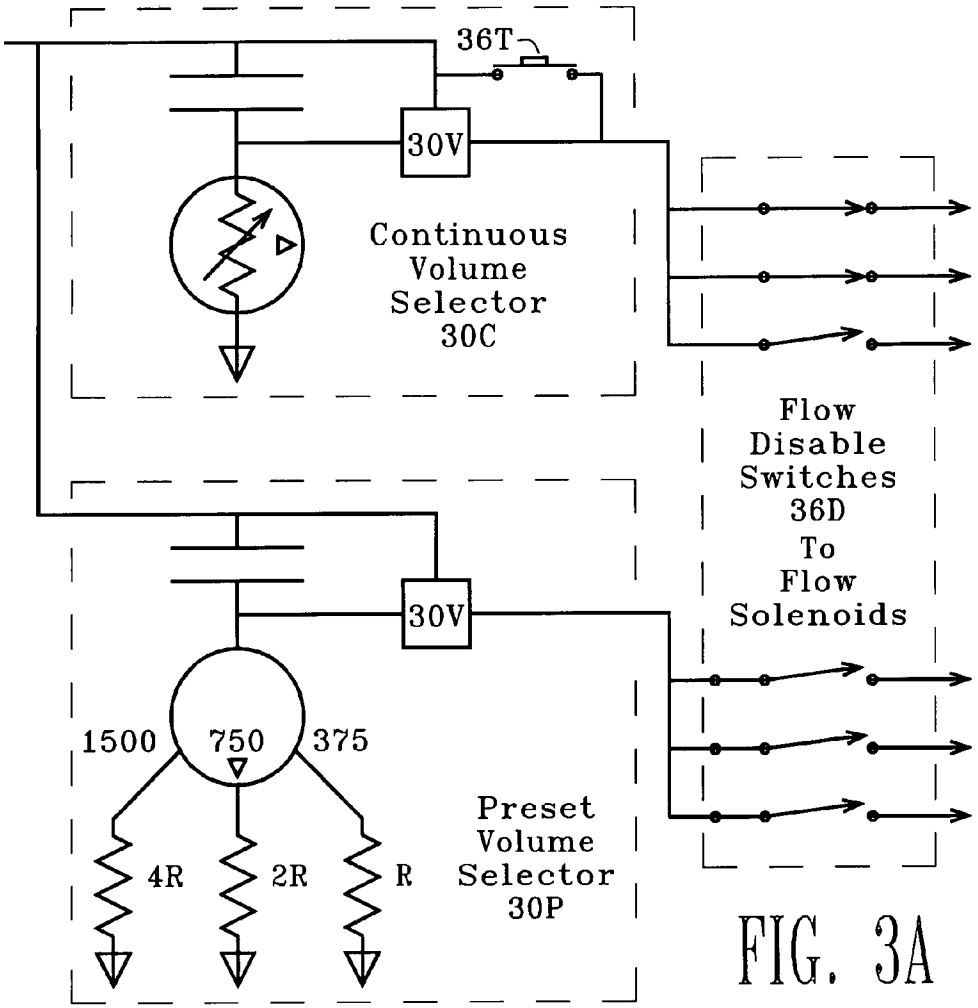
FIG. 3A is a schematic of a compound measure selector 30C and 30P for simultaneously defining two independent controlled measures in a "mixed run" embodiment.

Unequal Measure Embodiment—(FIGS. 3A and 3B)

In an unequal measure embodiment, a plurality of measure selections may simultaneously define a plurality of flow modes and a plurality of controlled measures of fluid stock. The controlled measures are simultaneously dispensed to a plurality of corresponding subsets of the receptacles (a mixed lot of different sizes). However, the flow modes have independent flow solenoids which close at independent T4*s*. In the embodiment shown in FIG. 3A, measure selectors 30C and 30P simultaneously define two controlled measures.

Selector 30C has a rotary variable resistance connected with a capacitor to form an R-C network. The continuously variable resistance values provide a continuous selection of R-C time constants, which define a continuous selection of measures. Voltage detector circuit 30V senses the changing voltage from the R-C network, and responds at a critical voltage to activate a solenoid(s). The operator turns selector 30C to the desired resistance (flow time). Top-off switch 36T over-rides the voltage detector circuit, and permits the operator to manually top-off any low measures.

Selector 30P has a rotary selector with a series of fixed detents, each having a fixed resistance. The resistance values define a series of fixed R-C time constants, preset for standard volumes V1, V2, V3 . . . Vn. For example, the wine industry has three main standard bottle sizes, 375 ml, 750 ml, and 1500 ml, requiring a short, medium, and long time constant. The R-C network in this embodiment has three fixed resistors R, 2R, and 4R, which provide the three time constants. The operator simply turns the selector knob to the desired bottle size.

Each bottle size (tall, medium, and squat) may require a matched fill spouts to accommodate the difference in bottle sizes. FIG. 3B shows long fill spout 30L for use with squat bottles, medium fill spout 30M for use with medium bottles and short fill spout 30S for use with tall bottles.

Flow Disable Switches

Flow disable switches 36D (shown in FIG. 3A) may be employed to disable at least some of the flow solenoids from opening, which prevents some of the fill spouts from passing fluid stock. The number of receptacles employed in each fill cycle may reduced by opening disable switches or increased by closing disable switches. The last fill cycle of a stock lot may involve less than a full measure of stock, and will require disabling some of the flow paths.

Figure 4:
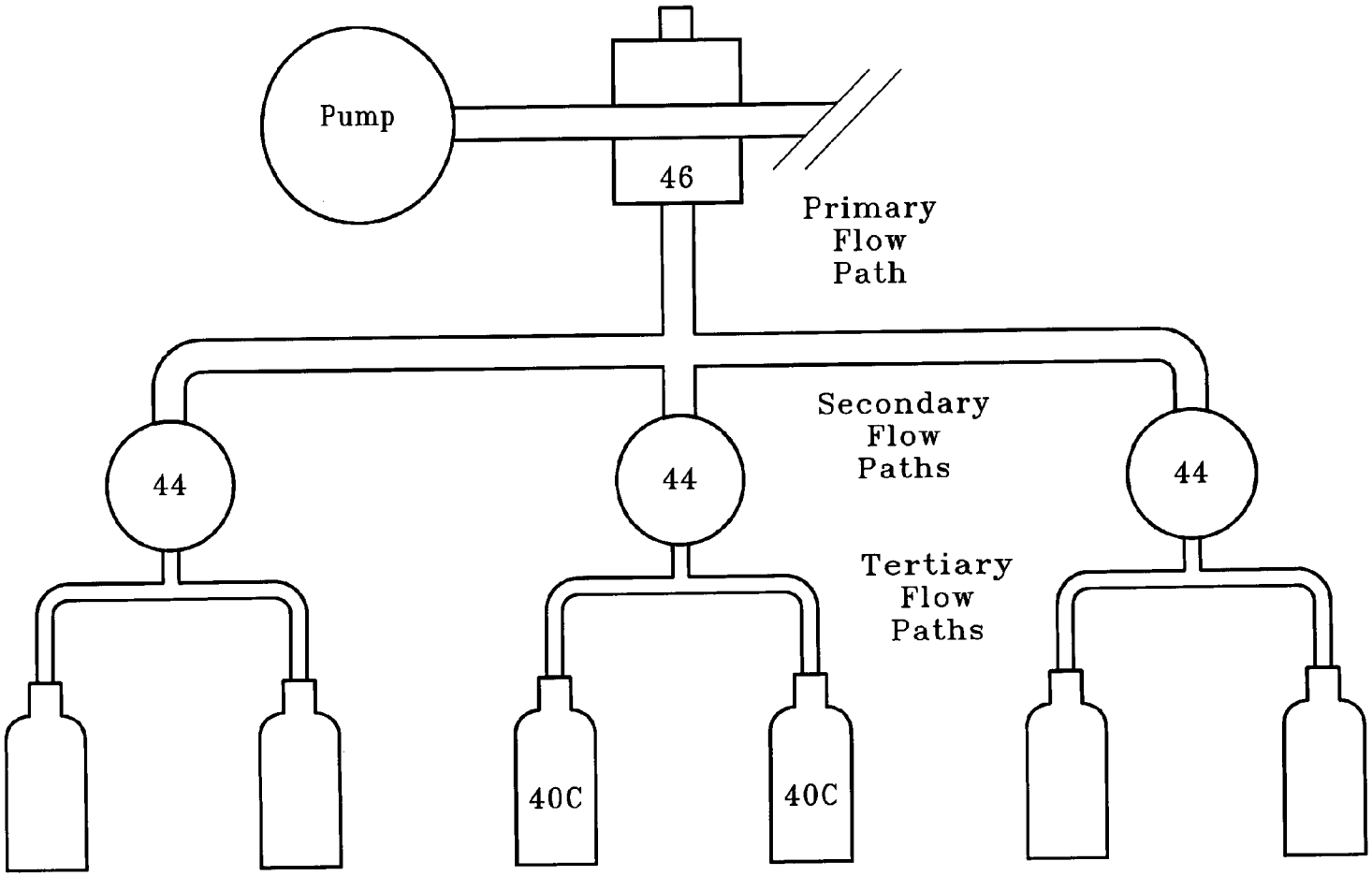
FIG. 4 is a flow schematic showing numerical relationships between flow solenoids 46 and flow constrictors 44 and receptacles 40C, illustrating primary and secondary and tertiary flows.

Primary-Secondary-Tertiary Flows—(FIG. 4)

In the embodiment of FIG. 2, distribution flow path 22D from each flow solenoid 26 has a single flow constrictor 24. The flow through the single constrictor is the same flow as the flow through the solenoid. This solenoid rich configuration offers specific control of the stock flows. The secondary flow embodiment of FIG. 4 shows a plurality of flow constrictors 44 in the stock flow path from each flow solenoid 46. There is a single primary flow through the solenoid and three secondary flows (constrictor flows) through the three constrictors. This constrictor rich configuration employs fewer costly solenoids.

In the embodiment of FIG. 2 the flow path from each flow constrictor 24 has a single stock receptacle. This constrictor rich configuration also offers specific control of the stock flows. The tertiary flow embodiment of FIG. 4 shows a plurality of stock receptacles 40C in the stock flow path from each flow constrictor 44. There is a single secondary flow through each constrictor and two tertiary flows (receptacle flows) into the two receptacles. This receptacle rich configuration employs fewer high maintenance constrictors such as needle valves.

Timed Flow Adjuster—(FIGS. 5A and 5B)

System timer SOT establishes a sequence of events defining a complete fill cycle of operation for fluid dispensing system 50. Timed flow adjuster 54 compensates each flow path for differences in "flow impedance" by adjusting the flow time. Flow impedance concerns the ability of a flow path to support fluid flow and is affected by the path length and path bends and other hydraulic considerations. Low impedance paths are faster than high impedance paths. The flow schematic of FIG. 5A shows the components and signals for a four flow path embodiment, and the timing diagram of FIG. 5B shows a timing waveform for each path. Timed signal CYCLE is applied from fill cycle timer 50F to pump SOP between T0 and T4. Four timed signals WAIT a–d are applied from timed flow adjuster 54 to four flow solenoids 56*a–d* for controlling the opening time of each solenoid. The timing diagram shows four Wait Windows a–d (one for each flow distribution path 52*a–d*) and four Flow Modes a–d. The duration of the wait windows is determined by wait timers 50*a–d* within system timer 50T. At the end of the wait windows, the solenoids open and the flow modes begin, allowing the flow of fluid stock. The length of time available for the flow mode (the flow time) for each flow path, is the fill cycle time minus the corresponding wait window. Adjusting the duration of the wait windows causes an inverse adjustment in the duration of the flow modes. By adjusting the fluid flow time, the measure of stock passing through each flow path into the receptacles may be adjusted to the desired controlled measure.

For example, the duration of Wait Window a may be adjusted by setting wait timer 50*a*. The length of time available for Flow Mode a is the fill cycle time minus Wait Window a. During Wait Window a, solenoid 56*a* is closed. During Flow Mode a, solenoid 56*a* is open and allows the flow of fluid stock through flow distribution path 52*a*. The duration of Wait Window a may be increased (or decreased) by wait timer 50*a* to decrease (or increase) the fluid flow time available for Flow Mode a. Wait timers permit the control of the dispensed measure to each bottle to within plus or minus ½ milliliter. Flow path 52*b* is slightly faster then flow path 52*a*, and requires less flow time to pass the same controlled measure. To effect a reduced flow time, Wait Window b has been adjusted by timer 50*b* to a duration slightly more then Wait Window a causing Flow Mode b to be slightly shorter than Flow Mode a. Flow path 52*c* is slightly slower then flow path 52*a*, and requires more flow time to pass the same controlled measure. Wait Window c has been adjusted by timer 50*c* to a duration slightly less then Wait Window a causing Flow Mode c to be slightly longer than Flow Mode a. Wait Window d has just about the same duration as Wait Window a because flow path 52*d* has about the same speed as flow path 52*a*.

The timed flow adjuster compensates for many factors affecting the speed of each flow path, such as:

1) Unequal transient times of mechanical components in the flow paths due to variations in manufacturing tolerances and subsequent aging.

2) Uneven delays in signal propagation through electrical components.

3) Unbalanced flow of fluid stock due to peculiar constrictions in the flow paths such as deposits and kinks.

4) Deviations from symmetry in the lay-out of the components and conduits, and the opening and closing order of the solenoids.

INDUSTRIAL APPLICABILITY

It will be apparent to those skilled in the art that the objects of this invention have been achieved !as described hereinbefore! by providing a fluid dispensing system employing an automated timed sequence of events which define a complete fill cycle. Once the sequence is initiated through a timer, each event of the sequence is self actuating until termination of the sequence at the end of the fill cycle. The system is automatic, and dispenses a controlled measure of fluid stock without close monitoring or intervention by operators. The system may have flow adjusters for adjusting the controlled measure of stock dispensed through each flow path into the receptacles. The adjuster compensates each flow path for differences in flow impedance. The system has a flexible distribution format which can execute mixed runs and partial runs of fluid stock. A different controlled measure may be assigned to different sub-portions of the system during a mixed run. A zero controlled measure may be assigned some flow paths during a partial run. The system has improved laminar flow, involving minimal turbulence and environmental exposure.

CONCLUSION

Various changes may be made in the structure and embodiments shown herein without departing from the concept of the invention. Further, features of embodiments shown in various figures may be employed in combination with embodiments shown in other figures. Therefore, the scope of the invention is to be determined by the terminology of the following claims and the legal equivalents thereof.

The invention claimed is:

1. Apparatus for dispensing a controlled measure of pressurized fluid stock from a stock source into stock receptacles, during a fill cycle, comprising:

flow manifold having an input port for receiving the pressurized fluid stock from the stock source, and having output ports for distributing the pressurized stock to the stock receptacles;

stock flow paths beginning at the manifold output ports and ending at each stock receptacle;

a fill spout at the receptacle end of each flow path, for passing the controlled measure of fluid stock into each stock receptacle;

flow valves in the flow paths between the output ports and the fill spouts, which open to allow the flow of fluid stock through the flow paths into the stock receptacles;

flow adjusters associated with at least some of the flow paths for adjusting the fluid flow to the controlled measure; and system timer for establishing a timed sequence of events defining a fill cycle of operation for the apparatus.

2. The apparatus of claim 1, wherein the flow valves are open/close electric solenoids mounted proximate to the manifold end of the stock flow paths.

3. The apparatus of claim 2, further comprising flow disable switches for preventing at least some of the flow solenoids from opening to prevent some of the fill spouts from passing fluid stock during a fill cycle.

4. The apparatus of claim 2, further comprising a stock pump between the stock source and the manifold input port which is turned on and off by the system timer, for creating pressure in the manifold which pressurizes the fluid stock, forcing fluid flow into the stock flow paths.

5. The apparatus of claim 4, wherein the stock pump has a turn-off transient which causes a manifold pressure tail within the manifold, and the flow solenoids have close transients which cause solenoid flow tails out of the solenoids; and the solenoid close transients are faster than the pump turn-off transient causing a portion of the manifold pressure tail to be trapped in the manifold as the solenoids close establishing a positive residual standby pressure between fill cycles.

6. The apparatus of claim 4, wherein the timed sequence of events comprises:

a fill cycle window during which the timed sequence of events is executed; and a wait window at the beginning of the fill cycle window during which the flow solenoids are closed; and a flow mode after the wait window during which the flow solenoids are open and fluid stock passes into the receptacles.

7. The apparatus of claim 6, further comprising a back pressure switch responsive to high manifold pressure for stalling the operation of the pump.

8. The apparatus of claim 7, wherein the timed sequence of events further comprises:

a prime mode within the wait window during which the stock pump stabilizes the volume and pressure of the fluid stock within the manifold; and a back pressure mode within the wait window during which the back pressure switch stalls the operation of the pump.

9. The apparatus of claim 6, further comprising:

sparge line for supplying inert sparge gas from a sparge gas source into the stock flow paths to the receptacles;

sparge release valve between the sparge gas source and the sparge line, responsive to the system timer for releasing sparge gas into the sparge line; and sparge injection apertures in the stock flow paths between the flow solenoid and the flow adjusters, for injecting sparge gas into the stock flow paths.

10. The apparatus of claim 9, further comprising sparge check valves in the sparge line between the sparge release valve and the sparge injection apertures, the check valves open in response to the sparge gas pressure in the sparge lines to inject sparge gas into the flow paths, and the check valves close to prevent leakage of fluid stock into the sparge line.

11. The apparatus of claim 8, wherein the timed sequence of events further comprises:

a sparge window during which the sparge release valve is open and inert sparge gas is injected into the stock flow paths.

12. The apparatus of claim 1, wherein the flow adjusters are flow constrictors positioned between the flow valve and the fill spout, for adjusting the rate of fluid flow through the flow paths.

13. The apparatus of claim 12, wherein the flow constrictors in the stock flow paths are positioned proximate the receptacle end of the flow paths.

14. The apparatus of claim 1, wherein the flow adjusters are flow timers which control the solenoids in the flow paths for adjusting the time of fluid flow in the flow paths.

15. The apparatus of claim 14, wherein each solenoid has a flow timer, and the flow timers control when the solenoids open to allow the flow of fluid stock.

16. The apparatus of claim 1, wherein the apparatus dispenses an equal measure of fluid stock to each receptacle.

17. The apparatus of claim 16, wherein the fluid flow rate through each flow adjuster is the same, and the flow solenoids are open for the same duration of time.

18. The apparatus of claim 1, further comprising a measure selector for defining the controlled measure of fluid stock dispensed to a set of the receptacles.

19. The apparatus of claim 1, further comprising a measure selector for simultaneously defining a plurality of controlled measures of fluid stock, for simultaneously dispensing the plurality of controlled measures to a plurality of corresponding subsets of the receptacles.

20. The apparatus of claim 1, wherein the fill spout at the receptacle end of each stock flow path is mounted proximate to the flow adjuster in that flow path.

21. The apparatus of claim 1, wherein the tip of each fill spout extends into a receptacle, and each fill spout is bent slightly to present the tip thereof along the inside surface of the receptacle to promote laminar fluid flow into the receptacle.

22. The apparatus of claim 21, further comprising a fill tray for supporting the stock receptacles during the fill cycle, which fill tray is at an angle up from the horizontal, causing the receptacles to incline away from the vertical.

23. The apparatus of claim 22, further comprising a housing having a side adjacent to the fill tray, which side extends upwards at an angle away from the vertical for supporting the inclined receptacles.

24. The apparatus of claim 22, wherein the fluid flow of the stock is down the inside surface of the inclined receptacle in a curtain of laminar flow.

25. The apparatus of claim 1, wherein the stock flow path from each flow solenoid has a single flow adjuster.

26. The apparatus of claim 1, wherein the stock flow path from each flow solenoid has a plurality of flow adjusters.

27. The apparatus of claim 1, wherein the stock flow path from each flow adjuster has a single stock receptacle.

28. The apparatus of claim 1, wherein the stock flow path from each flow adjuster has a plurality of stock receptacles.

29. Dispensing apparatus comprising:

fluid stock from a stock source to be dispensed in controlled measures into stock receptacles during a fill cycle;

flow manifold having an input port for receiving the fluid stock from the stock source, and having output ports for distributing the fluid stock to the receptacles;

stock flow paths beginning at the manifold output ports and ending at each receptacle;

a fill spout at the receptacle end of each flow path, for passing the controlled measure of fluid stock into each receptacle in a curtain of laminar flow down the inside surface of the receptacle;

flow valves in the flow paths between the output ports and the fill spouts, which open to allow the flow of fluid stock through the flow paths into the receptacles;

flow adjusters associated with at least some of the flow paths for adjusting the fluid flow to the controlled measure; and system timer for establishing a timed sequence of events defining a fill cycle of operation for the apparatus.

30. The apparatus of claim 29, wherein the curtain of laminar flow of fluid stock has a rotary component of flow sufficient to extend the flow completely around the inside of the receptacle forming a shroud of laminar flow.

31. The apparatus of claim 29, further comprising:

a sparge agent supplied by a sparge source to be injected into the stock flow paths and passed into the receptacles;

sparge line for conveying the sparging agent from the sparge source into the stock flow paths;

sparge release valve between the sparge source and the sparge line, responsive to the system timer for releasing the sparge agent into the sparge line; and sparge injection apertures in the stock flow paths between the flow solenoid and the flow adjuster, for injecting the sparge agent into the stock flow paths.

32. The apparatus of claim 31, wherein the sparge agent is a minor flow of an additive to be mixed with and become part of the dispensed controlled measure.

33. The apparatus of claim 31, wherein the sparge agent is an inert gas for shielding the stock flow during the dispensing.

* * * * *